US007340866B1

(12) United States Patent
Smith

(10) Patent No.: US 7,340,866 B1
(45) Date of Patent: Mar. 11, 2008

(54) WALL ADAPTER

(76) Inventor: Donald R. Smith, 5717 Estes Ave., Fort Worth, TX (US) 76119

( * ) Notice: Subject to any disclaimer, the term of this patent is extended or adjusted under 35 U.S.C. 154(b) by 740 days.

(21) Appl. No.: 09/791,051

(22) Filed: Feb. 22, 2001

(51) Int. Cl.
*E06B 1/02* (2006.01)
*E06B 1/36* (2006.01)
*E06B 1/52* (2006.01)

(52) U.S. Cl. ..... 52/204.54; 52/212; 52/217; 52/717.01; 52/745.15

(58) Field of Classification Search ..... 52/204.1, 52/204.56, 211, 212, 217, 213, 656.7, 205, 52/656.4, 656.5, 717.01, 745.15, 210, 656.1, 52/204.53, 214, 204.54; 49/505, 504
See application file for complete search history.

(56) References Cited

U.S. PATENT DOCUMENTS

| | | | | | |
|---|---|---|---|---|---|
| 1,724,601 | A | | 8/1929 | Kellog | |
| 1,926,673 | A | * | 9/1933 | Gregg | 52/211 |
| 3,126,986 | A | * | 3/1964 | Madl, Jr. | 52/210 |
| 3,469,350 | A | * | 9/1969 | Lange | 52/213 |
| 3,609,928 | A | * | 10/1971 | Mock | 52/210 |
| 3,654,734 | A | * | 4/1972 | Lehman | 49/505 |
| 3,858,377 | A | * | 1/1975 | Browne et al. | 52/775 |
| 3,906,671 | A | * | 9/1975 | Maldonado | 49/505 |
| 3,975,875 | A | | 8/1976 | Goss | |
| 4,281,481 | A | * | 8/1981 | Wendt | 49/504 |
| 4,407,100 | A | * | 10/1983 | Huelsekopf | 52/204.54 |
| 4,443,984 | A | * | 4/1984 | Rasmussen | 52/213 |
| 4,527,369 | A | | 7/1985 | Adams | |
| 4,606,162 | A | * | 8/1986 | Wendt | 52/282.4 |
| 4,840,002 | A | * | 6/1989 | Lovgren | 52/213 |
| 5,222,343 | A | | 6/1993 | Anderson | |
| 5,283,096 | A | | 2/1994 | Greenberg et al. | |
| 5,353,571 | A | | 10/1994 | Berdan et al. | |
| 5,426,897 | A | | 6/1995 | Gazaway | |
| 5,553,422 | A | | 9/1996 | Gazaway | |
| 5,694,722 | A | * | 12/1997 | Husting et al. | 52/35 |
| 5,706,623 | A | | 1/1998 | Brown | |
| 5,937,597 | A | * | 8/1999 | Sono et al. | 52/204.1 |
| 6,006,489 | A | * | 12/1999 | Zadok | 52/773 |

FOREIGN PATENT DOCUMENTS

| | | | | |
|---|---|---|---|---|
| DE | 1509258 | * | 2/1968 | 52/213 |
| FR | 1532282 | * | 7/1968 | 52/210 |

OTHER PUBLICATIONS

Raco Alttura brochure(2 pages).

* cited by examiner

*Primary Examiner*—Lanna Mai
*Assistant Examiner*—Phi Dieu Tran A
(74) *Attorney, Agent, or Firm*—Thompson & Gustavson L.L.P.

(57) ABSTRACT

A wall adapter system (10) having a wall adapter (12) is disclosed. The wall adapter (12) permits a mullion (16) to be secured to a wall (14) through the wall adapter (12) without the need for trimming or caulking. The wall adapter (12) has a front portion (26) with a mullion snap interlock (56) and first and second side portions (28, 30) with snap cover trim interlocks (68). The mullion (16) is snap fit on the front portion at the interlock (56) while cover trim (70) are snap fit on the side portions (28, 30) at the snap cover trim interlocks (68). The front portion (26) can be formed into parts, a main portion (104) and an adjustment portion (106) which allows the wall adapter to be mounted to a range of wall thicknesses. The wall adapter (12) can be used with a block header (150).

22 Claims, 5 Drawing Sheets

WALL ADAPTER

TECHNICAL FIELD

This invention relates to building construction, and in particular, to the interface between a wall and a mullion for mounting a glass window or door.

BACKGROUND OF THE INVENTION

Often, in building construction, there must be an interface between a wall and a glass window or door. This interface can either be in interior construction, such as the entrance to an office, or a divider wall, or exterior, such as the front entrance to an office or store.

Typically, the glass window is mounted within a mullion which has a deep groove to receive the edge of the glass. This mullion is typically attached directly to the wall structure, usually a stud. The stud can be wood or metal. In such an installation, additional work must be undertaken to trim and caulk the mating edges of the mullion and wall. The installation is time-consuming and expensive. A need exists for a more efficient and less costly system. This is particularly true for interior construction as interior office walls are often changed each time a new lessee takes over an office space.

SUMMARY OF THE INVENTION

In accordance with one aspect of the present invention, a wall adapter is provided for fastening a mullion to a wall. The wall adapter includes a member having a first portion of predetermined width. The member also has a first side extending from a first edge of the first portion and a second side extending from a second edge of the first portion. Each of the first portion, first side portion and second side portion have an inner surface. The inner surfaces of the first portion and first and second side portion engage the wall. The first portion also has an outer surface, the mullion being received on the outer surface of the first portion.

In accordance with another aspect of the present invention, the first portion has a mullion snap interlock on the outer surface. In accordance with another aspect of the present invention, the first and second sides each have a snap cover trim interlock.

In accordance with yet another aspect of the present invention, the first portion is formed of a first half and a second half, the first side portion extending from the first half and the second side portion extending from the second half, permitting the wall adapter to be used with a range of wall thicknesses.

The wall adapter can be used with a block header for forming the upper portion of a window or door frame.

BRIEF DESCRIPTION OF THE DRAWINGS

For a more complete understanding of the present invention and the advantages thereof, reference is now made to the following Detailed Description, taken in conjunction with the accompanying Drawings, in which.

DETAILED DESCRIPTION

Figure 1:
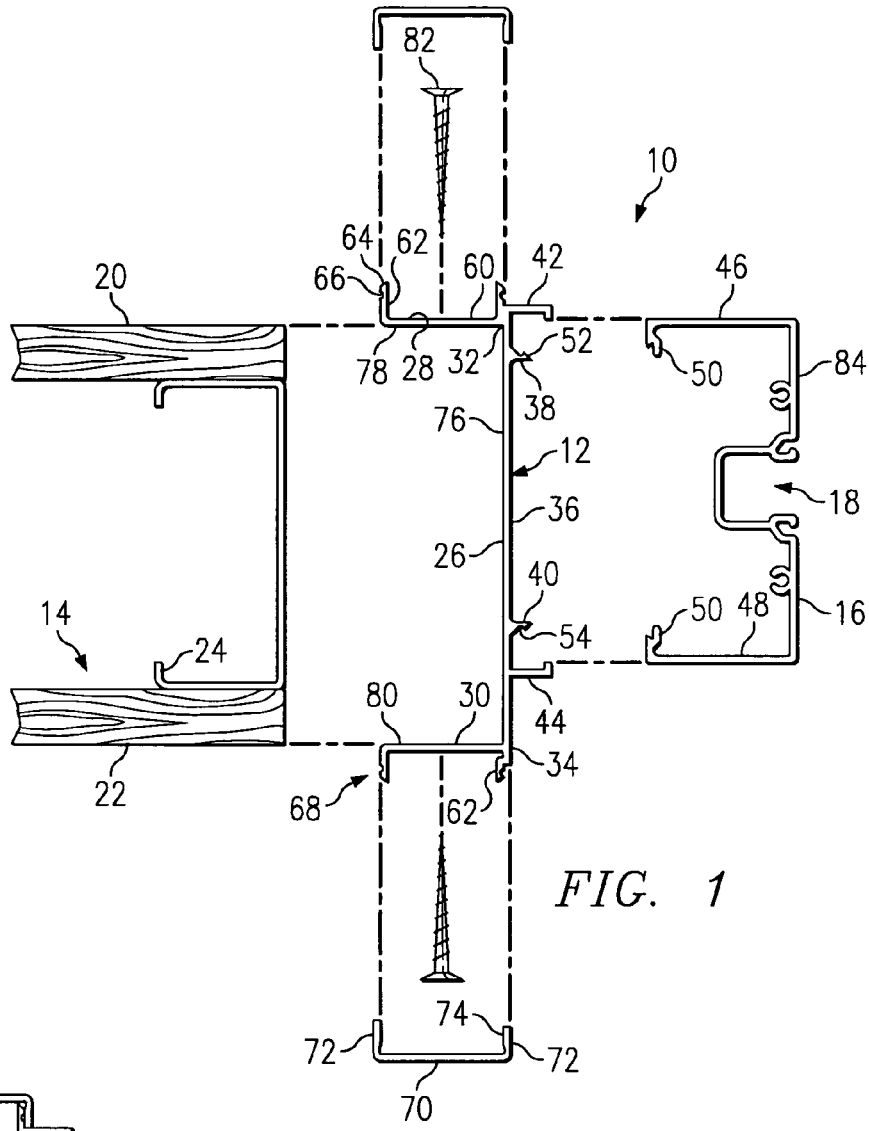
FIG. 1 is an exploded plan view of a wall adapter system forming a first embodiment of the present invention.

With reference now to the drawings, a wall adapter system 10 with a wall adapter 12 will be described. The wall adapter system 10 is used to provide the interface between a wall 14 and a mullion 16. The mullion 16 is used to support a glass window or door at a slot 18 formed in the mullion 16.

The wall 14 is typically constructed of an inner drywall panel 20, an outer drywall panel 22 and a wall stud 24. In the past, the mullion 16 was typically fastened directly to the wall stud 24 by a screw or nail inserted at the back of the slot 18. However, such an installation required caulking the interface between the wall 14 and the mullion 16 and installation of trim to provide a pleasing appearance. This requires time and skilled labor and is thus expensive.

Figure 2:
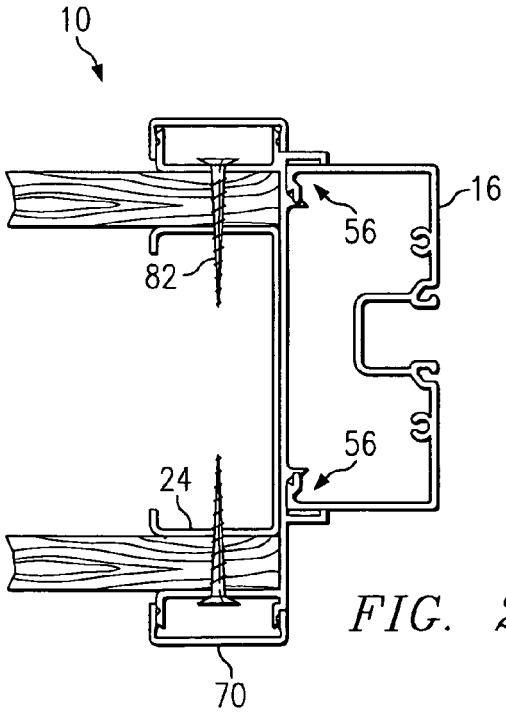
FIG. 2 is a plan view of the wall adapter system of FIG. 1.

By use of the wall adapter system 10, the need for caulking and trim installation is eliminated, saving time and labor. With reference to FIGS. 1 and 2, the wall adapter 12 can be seen to have a front portion 26, a first side portion 28 and a second side portion 30. The first side portion 28 extends from a first edge 32 of the front portion 26 generally perpendicular to the width of the front portion 26. Similarly, the second side portion extends from the opposite second edge 34 of the front portion 26 generally perpendicular to the width of the front portion 26 and generally parallel to the first side portion 28.

The front portion 26 has an outer surface 36 from which extends inner snap hooks 38 and 40. Also extending from the outer surface 36 and proximate inner snap hooks 38 and 40 are outer walls 42 and 44. The mullion 16 has a first side 46 and a second side 48. Each side 46 and 48 has an inwardly directed lip 50. The mullion 16 is snap fit onto the front portion 26 of the wall adapter 12 as best illustrated in FIG. 2. The inwardly directed lip 50 of each side of the mullion is inserted between facing inner snap hooks 38 and 40 and outer walls 42 and 44. The snap hooks 38 and 40 have camming surfaces 52 which cause the inner snap hooks 38 and 40 to deflect inwardly as the inwardly directed lip 50 moves between the inner snap hooks and outer walls. The inner snap hooks 38 and 40 also have a notch 54 into which the inwardly directed lips 50 are fit when the mullion 16 is pushed sufficiently between the inner snap hooks and outer walls. The outer walls 42 and 44 provide sufficient support to the sides 46 and 48 of the mullion 16 to cause the inner snap hooks 38 and 40 to deflect as described to capture the mullion 16. Thus, the inner snap hooks 38 and 40 and outer walls 42 and 44 define a mullion snap interlock 56.

Each side portion 28 and 30 defines an outer surface 60. Extending outwardly from each edge of the outer surface 60 is a snap hook 62. Each snap hook 62 has a cam surface 64 and a notch 66 facing outward. The snap hooks 62 define a snap cover trim interlock 68 to receive cover trim 70. The cover trim 70 is formed with sides 72 which define an inner protrusion 74. As can be seen in FIG. 2, a cover trim 70 can be snap fit to a side portion 28 or 30 of the wall adapter 12 by urging the cover trim 70 against the snap hooks 62, engaging the cam surfaces 64 to deflect the snap hooks 62 inwardly until the protrusions 74 on the cover trim 70 engage the notches 66 to secure cover trim 70 on the wall adapter 12.

In use, a wall adapter 12 can be positioned with the inner surfaces 76, 78 and 80 of the front portion 26, first side portion 28 and second side portion 30, respectively, engaging the drywall panels 20 and 22 and wall stud 24, as seen in FIG. 2. Suitable fasteners, such as screws 82, nails or other fasteners can be driven through the side portions 28 and 30 into the drywall panels 20 and 22 and the wall stud 24 to secure the wall adapter 12 to the wall. The outer surfaces 60 of the side portion 28 and 30 thus define a fastener raceway. Subsequently, the mullion 16 can simply be snap fit onto the front portion 26 of the wall adapter 12 and the cover trim 70 can be snap fit onto the first and second side portions 28 and 30, hiding the fasteners, to complete the construction.

While the wall adapter 12 can be made from many different materials, it is preferably formed of aluminum. The wall adapter 12 will be extruded in convenient lengths with the cross section shown in FIGS. 1 and 2. A convenient length extrusion would be 24 feet long. The extrusion can be cut to the exact length needed for the installation. The ends are commonly mitered as well. The wall adapter 12 can also be formed of stainless steel, bronze or vinyl. The cover trim 70 and mullion 16 will also typically be formed of aluminum. However, other materials, such as stainless steel, bronze and vinyl can be used for the cover trim 70 and mullion 16 as well.

In one wall adapter system 10 constructed in accordance with the teachings of the present invention, the wall adapter system 10 is designed for use with a wall having a thickness of 4⅞ inches. In this construction, the cover trim 70 is about 1½ inch wide and sides 72 are 7/16 th inch long. The mullion 16 is about four inches wide. Thus, the separation between the outer walls 42 and 44 is also about four inches. The distance between the inner surfaces 78 and 80 is about 4⅞ inches. The distance between the sides 72 of the cover trim 70 most distant from the mullion 16, and the outward facing surface 84 of the mullion is about 3¼ inches.

Figure 3:
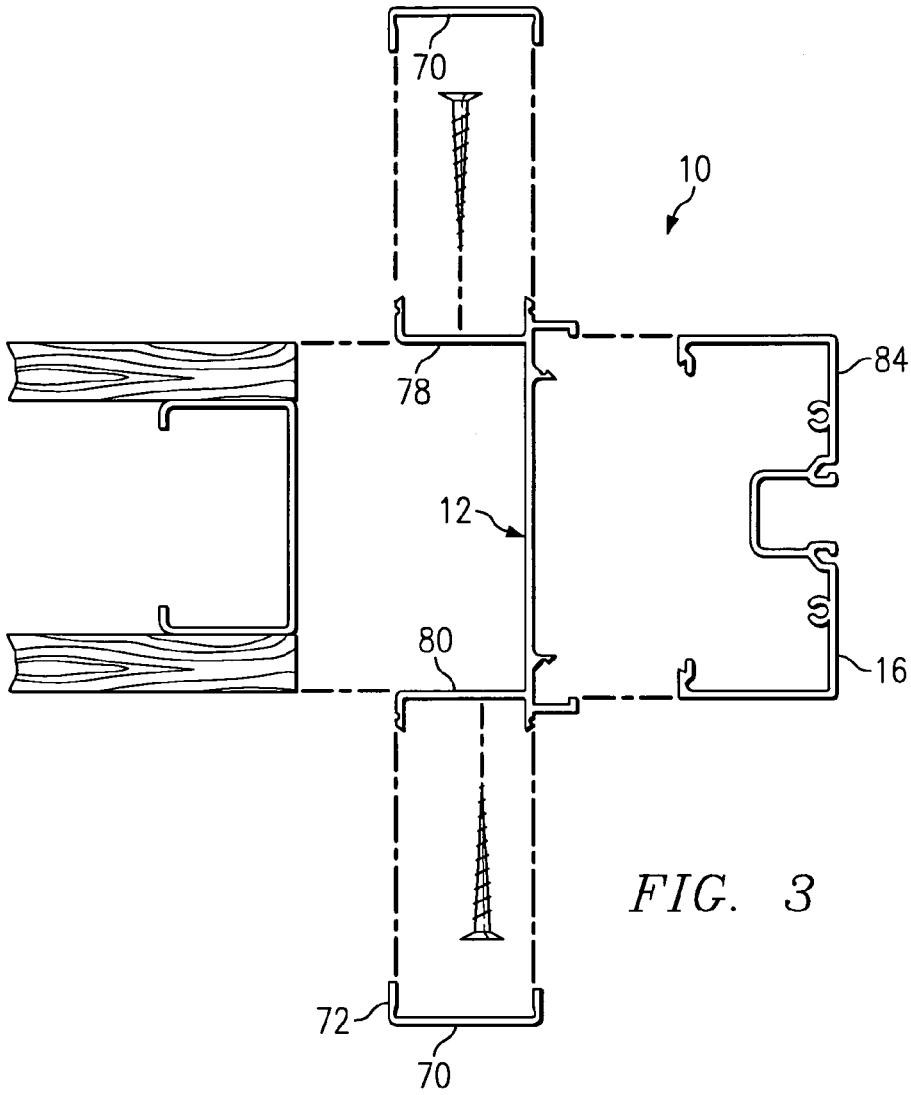
FIG. 3 is an exploded plan view of a wall adapter system forming a first modification of the wall adapter system of FIGS. 1 and 2.
Figure 4:
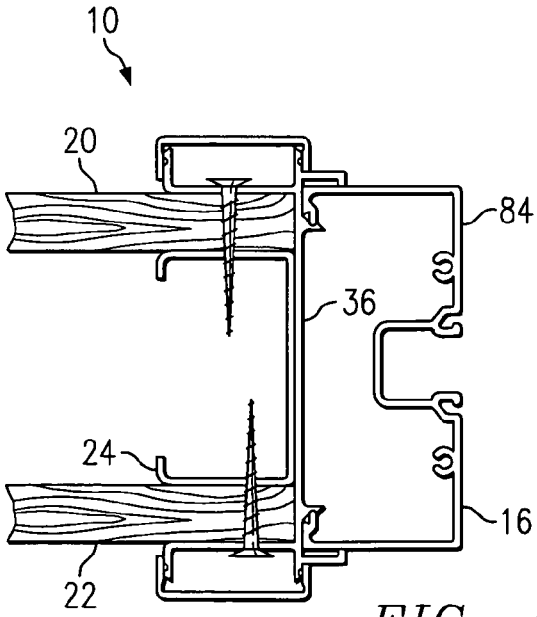
FIG. 4 is a plan view of the wall adapter system of FIG. 3.

With reference to FIGS. 3 and 4, a modification of the wall adapter system 10 is illustrated. The only differences between the wall adapter system 10 of FIGS. 1 and 2 and the wall adapter system 10 of FIGS. 3 and 4 is that the wall adapter system 10 of FIGS. 3 and 4 is designed for use with a wall thickness of 3¾ inches. In such a design, the only dimensional differences from those described above are the fact that the distance between the inner surfaces 78 and 80 is about 3¾ inches while the distance between the sides 72 of the cover trim 70 spaced most distance from the mullion 16, and the outwardly facing surface 84 of the mullion 16 is about 3 3/16 inches.

Figure 5:
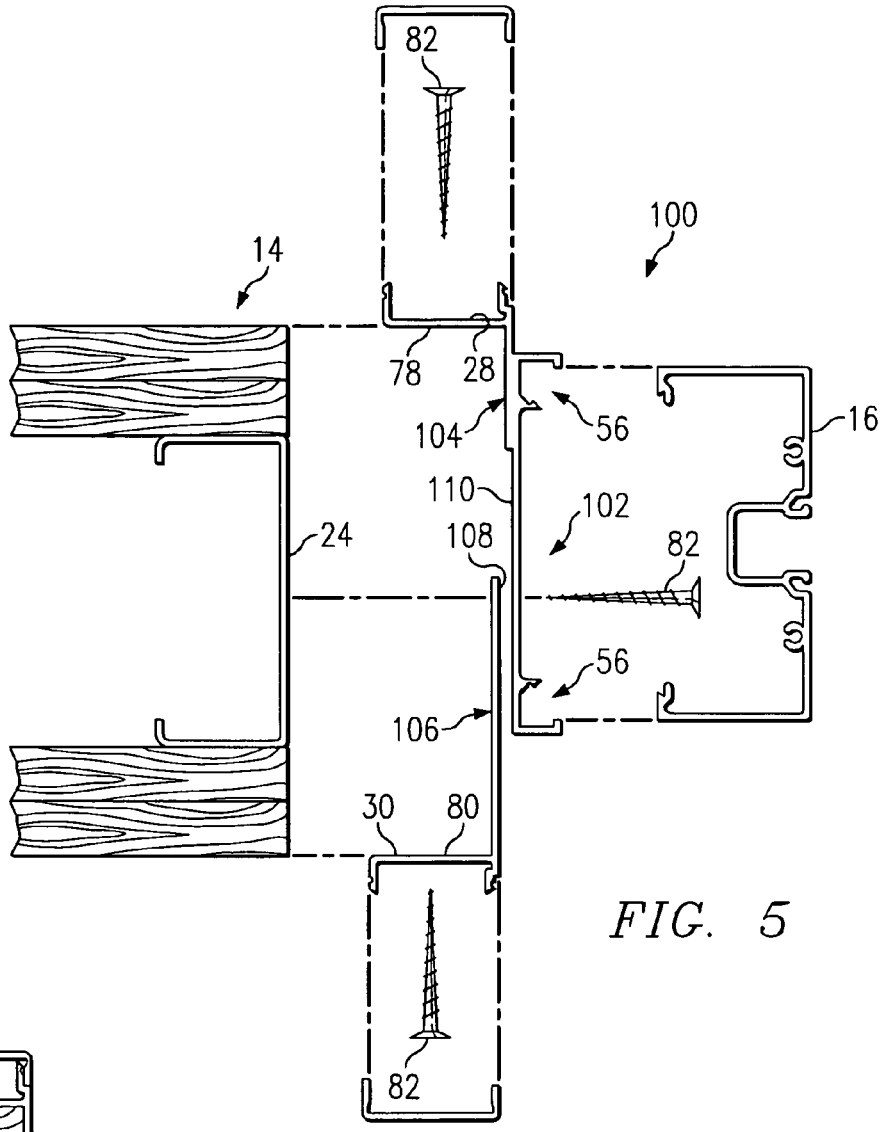
FIG. 5 is an exploded plan view of a wall adapter system forming a second embodiment of the present invention which can be used with a range of wall thicknesses.
Figure 6:
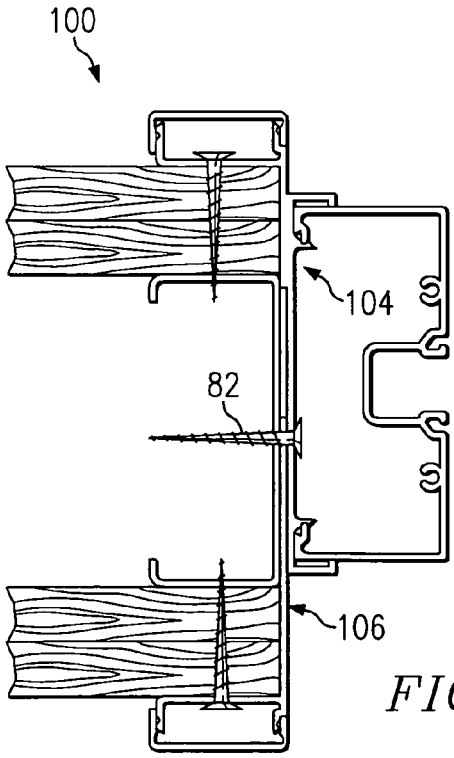
FIG. 6 is a plan view of the wall adapter system of FIG. 5.

With reference to FIGS. 5-6, a wall adapter system 100 forming a second embodiment of the present invention will be described. In wall adapter system 100, the wall adapter 102 is formed in two pieces. A main portion 104 includes first side portion 28 and the mullion snap interlock 56. The adjustment portion 106 includes the second side portion 30. The main portion 104 and adjacent adjustment portion 106 can slide relative to each other with the outer surface 108 of the adjustment portion 106 engaging the inner surface 110 of the main portion 104. This allows the distance between the surfaces 78 and 80 to be adjusted so that the wall adapter 102 can be used with a range of wall thicknesses. For example, the wall adapter 102 can be designed to be installed on walls 14 between a thickness of 4⅝ inches to 7 inches. As can be seen, the mullion 16 will be mounted in a consistent relationship to the first side portion 28. However, the second side portion 30 may be spaced closer or further away from the mullion 16 depending on the thickness of the wall 14. In this design, a screw 82, or other suitable fastener, such as a nail, is driven through overlapping sections of the main portion 104 and adjustment portion 106 into the stud 24 to secure the wall adapter system 100 to the wall 14. If used, the screw 82 or other fastener is concealed by the mullion 16 when it is snap fit over the wall adapter 102. While less desired, the fastener between the portions 104 and 106 and the stud could be eliminated.

Figure 7:
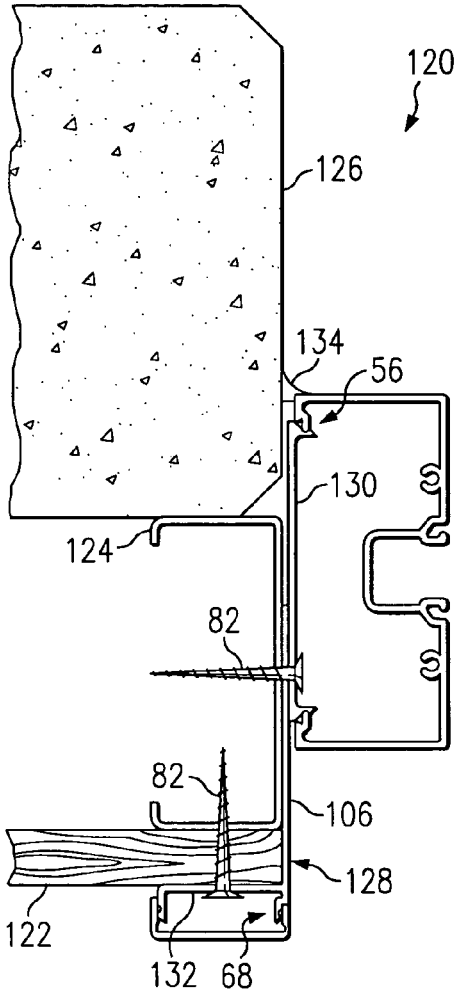
FIG. 7 is a plan view of an alternative installation of the wall adapter system of FIG. 5.

FIG. 7 illustrates a wall adapter system 120 forming a third embodiment of the present invention utilized in a building environment with an exterior wall panel 122, stud 124 and a concrete wall 126. The wall adapter system 120 includes a wall adapter 128 which has only a front portion 130 and a side portion 132. The wall adapter 128 is secured to the wall by screws 82 through both the side portion 132 and front portion 130. As previously described, the side portion 132 has snap cover trim interlock 68 and front portion 130 has mullion snap interlock 56 to receive the cover trim and mullion 16. In the absence of a second side portion, the wall adapter system 120 preferably has a line of sealant 134 to seal between the concrete wall 126 and the corner of the mullion 16.

Figure 8:
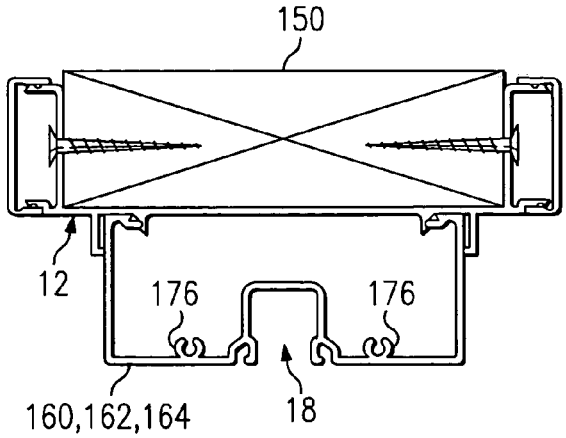
FIG. 8 is a vertical cross section view of a wall adapter system utilized with a block header.
Figure 9:
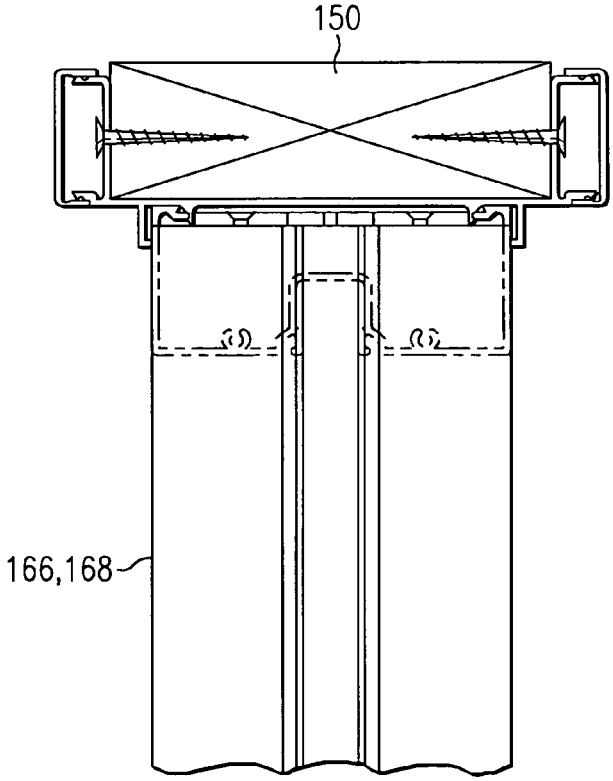
FIG. 9 is a vertical cross section view of the wall adapter system of FIG. 8 illustrating the vertical frame member.
Figure 10:
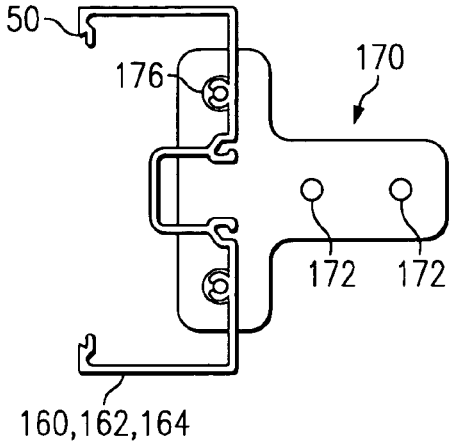
FIG. 10 is a plan view of a mullion anchor clip.
Figure 11:
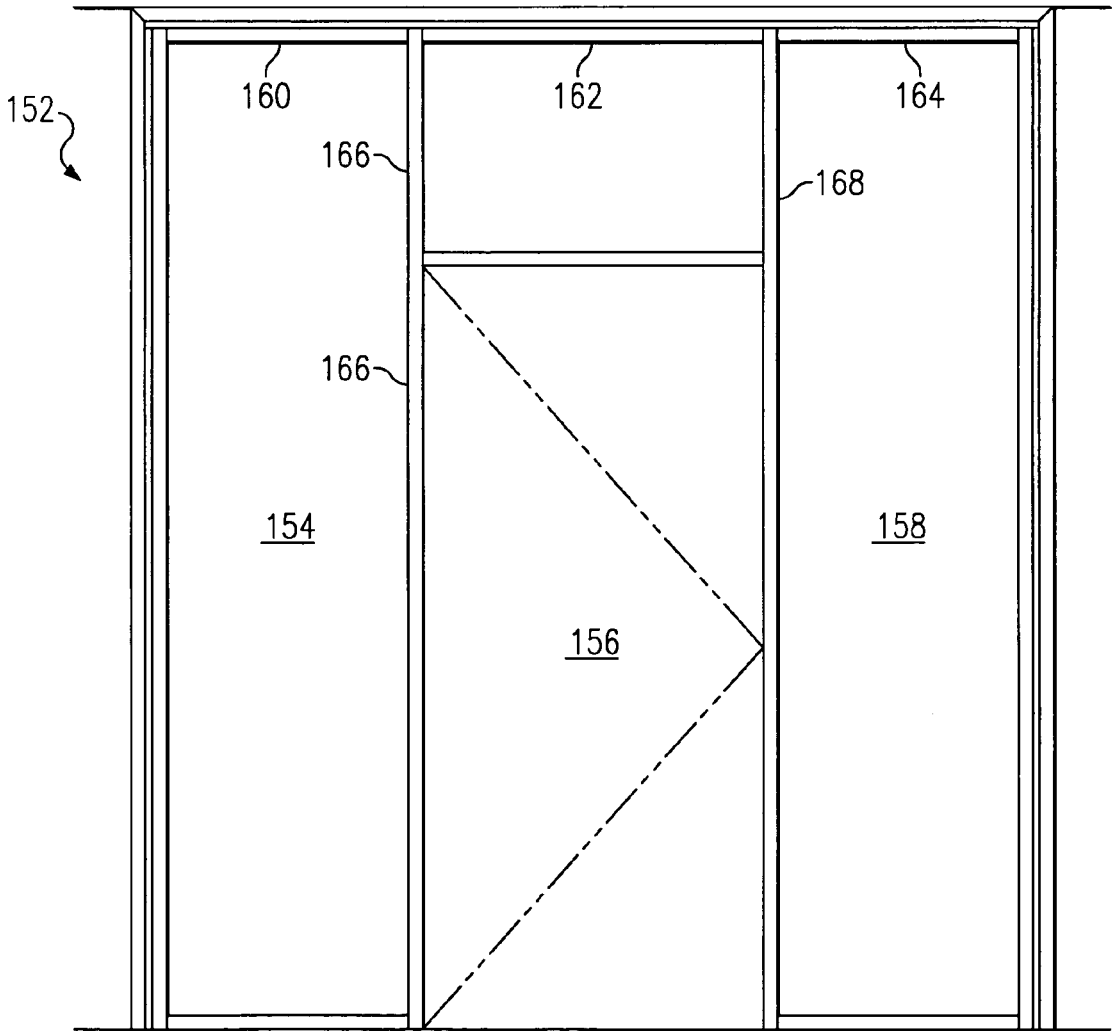
FIG. 11 is a side view of a window and door frame with trim incorporating the system of the present invention.

With reference to FIGS. 8-11, the wall adapter system 10 is illustrated for use with a block header 150 to form a door and window frame 152 as shown in FIG. 11. As seen in FIG. 8, a block header 150 is installed horizontally at the top of the door and window frame 152. A wall adapter 12 is secured to the block header 152 just as it would be secured to the wall 14 and extends the entire length of the block header 150 including window opening 154, door opening 156 and window opening 158. Mullion sections 160, 162 and 164 are snap fit to the wall adapter 12, permitting vertical frames 166 and 168 to be inserted between adjacent mullions 160, 162 and 164. A mullion anchor clamp 170 is secured to an end of selected mullions 160, 162 and 164. The mullions 160, 162 and 164 typically have snap fit members 176 onto which the clip 170 is snap fit. The clamp includes apertures 172 to attach the vertical frame members 166 and 168 to the clip 170.

Although several embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit and scope of the invention.

The invention claimed is:

1. A wall adapter for fastening a mullion to a wall, the mullion mounting a window or door, the mullion being a single piece and having first and second sides, comprising:

a member having a first portion, a first side portion extending from a first edge of the first portion and a second side portion extending from a second edge of the first portion, the first portion, first side portion and second side portion engaging the wall; and the first portion having a first surface for receiving the single piece mullion, the window or door being mounted to the mullion, the mullion being secured to the wall only through the member and wherein the first portion has first and second inner snap hooks and adjacent first and second outer walls, the mullion snap fit between adjacent inner snap hooks and outer walls, the outer walls exterior the first and second sides of the mullion.

2. The wall adapter of claim 1 wherein the first portion, the first side portion and the second side portion each define an inner surface, the inner surfaces of the first portion, first side portion and second side portion engaging the wall.

3. The wall adapter of claim 1 wherein the first portion has a mullion snap interlock.

4. The wall adapter of claim 1 wherein the first and second side portions have cover trim interlocks.

5. The wall adapter of claim 1 wherein the first and second side portions each have first and second snap hooks extending therefrom, a trim panel snap fit to the snap hooks.

6. The wall adapter of claim 1 wherein the wall is a block header.

7. The wall adapter of claim 1 wherein the first and second inner snap hooks include a camming surface and a notch receiving a portion of the mullion when the mullion is snap fit to the first portion.

8. A method of construction using a wall and a single piece mullion, the mullion mounting a window or a door, comprising the steps of:

securing a wall adapter to the wall, the wall adapter having a first portion of predetermined width, at least one side portion extending from a first edge of the first portion;

snap fitting a single piece mullion onto the first portion of the wall adapter, the mullion being secured to the wall only through the wall adapter;

mounting the window or door to the mullion; and adjusting a main portion of the first portion relative to an adjustment portion of the first portion to adapt the wall adapter to a wall thickness within a predetermined range of wall thicknesses.

9. The method of construction of claim 8 further comprising the step of snap fitting a cover trim to the side portion.

10. The method of construction of claim 8 wherein the step of securing the wall adapter to the wall includes the step of screwing the wall adapter to the wall with at least one screw.

11. The method of construction of claim 8 wherein the step of securing the wall adapter to the wall includes the step of screwing the wall adapter to the wall with at least one screw through the side portion and at least one screw through a second side portion extending from a second edge of the first portion.

12. The method of construction of claim 8 further comprising the step of fastening the wall adapter to the wall where a section of the main portion and the adjustment portion overlap.

13. The method of construction of claim 8 wherein the step of securing a wall adapter to the wall includes a step of mounting the wall adapter to a block header.

14. The method of construction of claim 13 further comprising the step of securing a mullion anchor clip up to the mullion and then securing a frame member to the mullion anchor clip.

15. The method of construction of claim 8 wherein the step of snap fitting a mullion onto the first portion of the wall adapter includes the step of snap fitting a storefront mullion onto the first portion of the wall adapter.

16. A wall adapter system including:

a wall having a predetermined thickness;

a single piece mullion mounting a door or a window, the single piece mullion having a first side and a second side, each side having an inwardly directed lip;

a cover trim;

a wall adapter having a first portion of predetermined width, at least one side portion extending from a first edge of the first portion, the first portion having a mullion snap interlock thereon, the mullion snap fit on the mullion snap interlock, the side portion having a cover trim interlock, the cover trim snap fit on the cover trim interlock, the mullion being secured to the wall only through the wall adapter, the first portion having outer walls forming a portion of the mullion snap interlock, the outer walls covering a portion of the first and second sides of the single piece mullion.

17. The wall adapter system of claim 16 wherein the mullion is a storefront mullion.

18. A wall adapter for fastening a mullion to a wall, the mullion mounting a window or door, the mullion being a single piece and having first and second sides, comprising:

a member having a first portion, a first side portion extending from a first edge of the first portion and a second side portion extending from a second edge of the first portion, the first portion, first side portion and second side portion engaging the wall; and the first portion having a first surface for receiving the single piece mullion, the window or door being mounted to the mullion, the mullion being secured to the wall only through the member, wherein the first portion is formed of a main portion and an adjustment portion, the first side portion extending from the main portion and the second side portion extending from the adjustment portion, the separation of the first and second side portions being adjustable to permit the wall adapter to be used with a range of wall thicknesses.

19. The wall adapter of claim 18 wherein the first portion, the first side portion and the second side portion each define an inner surface, the inner surfaces of the first portion, first side portion and second side portion engaging the wall.

20. The wall adapter of claim 18 wherein the first portion has a mullion snap interlock.

21. The wall adapter of claim 18 wherein the first and second side portions have cover trim interlocks.

22. The wall adapter of claim 18 wherein the first portion has first and second inner snap hooks and adjacent first and second outer walls, the mullion snap fit between adjacent inner snap hooks and outer walls, the outer walls exterior the first and second sides of the mullion.

* * * * *